United States Patent [19]

King

[11] 4,411,081

[45] Oct. 25, 1983

[54] TRENCH COMPACTOR HAVING A VIBRATORY SHEEPSFOOT ASSEMBLY

[76] Inventor: Reginald D. King, 16252 Colfax Hwy., Grass Valley, Calif. 95945

[21] Appl. No.: 339,616

[22] Filed: Jan. 15, 1982

[51] Int. Cl.[3] ..... E02F 3/76; E01C 19/38

[52] U.S. Cl. ..... 37/117.5; 37/DIG. 18; 404/121; 404/128

[58] Field of Search ..... 37/117.5, 103, DIG. 18, 37/DIG. 3; 404/121, 128, 127, 133

[56] References Cited

U.S. PATENT DOCUMENTS

| | | | |
|---|---|---|---|
| 3,136,078 | 6/1964 | Renault | 404/121 X |
| 3,595,411 | 7/1971 | Ables | 37/103 X |
| 3,703,128 | 11/1972 | Fransson | 404/128 |
| 3,724,342 | 4/1973 | Caron et al. | 404/121 |
| 3,743,358 | 7/1973 | Guest | 37/117.5 X |
| 3,989,404 | 11/1976 | Burton | 37/DIG. 3 |
| 4,023,288 | 5/1977 | Roe | 37/103 X |
| 4,066,374 | 1/1978 | King | 404/121 X |
| 4,100,688 | 7/1978 | Grist | 37/117.5 |
| 4,189,854 | 2/1980 | Haynes | 37/DIG. 3 X |
| 4,278,368 | 7/1981 | Livesay | 404/121 |

FOREIGN PATENT DOCUMENTS

| | | | |
|---|---|---|---|
| 6610700 | 1/1967 | Netherlands | 404/121 |
| 861504 | 2/1961 | United Kingdom | 404/121 |
| 2027096 | 2/1980 | United Kingdom | 37/103 |

*Primary Examiner*—E. H. Eickholt

*Attorney, Agent, or Firm*—Mark C. Jacobs

[57] ABSTRACT

A sheepsfoot assembly including a sheepsfoot frame section, an engine housing section with protective canopy, a vibratory sheepsfoot drum assembly mounted in the frame section, the drum assembly containing a rotatable drum with an internal bearing and eccentric shaft assembly and a plurality of spaced compacting teeth on the drum. The sheepsfoot drum is rotated when the machine is pushed or pulled over the soil by the prime mover to which the sheepsfoot assembly is attached. The drum is not powered for rotation, but only for vibration by the engine assembly.

The sheepsfoot frame includes a mounting jaw arrangement for securing the machine to the integral lip of certain prime movers, e.g., front end loader, or to an added lip as for attachment to dozer blades. In this manner, the prime mover can straddle a trench and the sheepsfoot assembly can be then lowered into the trench until it contacts a backfill layer for soil compaction.

9 Claims, 7 Drawing Figures

TRENCH COMPACTOR HAVING A VIBRATORY SHEEPSFOOT ASSEMBLY

BACKGROUND OF THE INVENTION

1. Field of the Invention

The invention relates to earth compacting equipment; and, more particularly, to an improved vibratory sheepsfoot assembly adapted to be mounted to a tractor or the like for use in narrow trench compaction.

2. Description of the Prior Art

There are various types of machines known in the art used to compact earth. One such type of machine is known as a sheepsfoot and is described in detail in U.S. Pat. No. 3,183,804. In U.S. Pat. No. 4,066,374, commonly assigned, there is described such apparatus and the known prior art of which the trench compactor described in U.S. Pat. No. 4,066,374 was an improvement. A more recent patent to Livesay, U.S. Pat. No. 4,278,368, describes a sheepsfoot which is attached to the bucket of a tractor or the like.

The trencher in U.S. Pat. No. 4,278,365 straddles a trench and compacts the earth by means of the sheepsfoot. In this manner, the operator can dig a trench, lay pipe, back fill with the trencher, then compact the dirt back again with the other end of the sheepsfoot.

One such sheepsfoot is described in detail in U.S. Pat. No. 3,891,342. The sheepsfoot, as described there, includes a rotatable cylinder having spaced teeth which vibrate into the dirt to compact the soil. Of the prior art sheepsfoot rollers some can not work within a narrow trench such as a twenty-four (24) inch wide trench, others are not productive in a narrow trench environment. Further, such prior art devices do not work efficiently in compacting all types of soils, such as cohesive clays, clay mixes and granular native materials. It is desirable to have such a sheepsfoot which can be quickly and easily mounted to, or demounted from, a loader bucket or similar lip on a prime mover blade and can compact soil quickly and operate in relatively narrow trenches than known prior art devices. Such a device should be able to produce specification compaction in native soils or the like without breakage of pipe laid in the trench.

SUMMARY OF THE INVENTION

It is an object of this invention to provide an improved vibratory sheepsfoot for compacting soil in trenches.

It is a further object of this invention to provide such improved sheepsfoot with a new and novel coupling assembly which can be quickly and easily mounted to, or demounted from, the lip of a loader bucket or the similar lip of other prime movers.

It is another object of this invention to provide such improved sheepsfoot which can compact native soils or the like to specification without pipe breakage.

It is yet another object of this invention to provide a sheepsfoot type earth compactor for use in trenches which can be operated from completely outside of the trench.

It is still further object to provide a sheepsfoot device that is readily maneuverable for operation within a confined trench environment.

Yet another object is to provide a tool for soil compaction the use of which does not require any laborer to the trench where compaction is to transpire.

These and other objects are preferably accomplished by providing a sheepsfoot assembly having an upper vibratory machine housing section, a vibratory sheepsfoot machine mounted on said section, a lower drum section, a rotatable drum mounted in the lower drum section and a plurality of spaced compacting teeth on the drum. The drum is rotated when the prime mover moves forwardly or rearwardy, the only internal movement of the drum being vibratory to compact soil. The sheepsfoot assembly also includes flanges on the lower drum section for securing the assembly to the lip of a bull dozer or the like. In this manner, the bull dozer or tractor can straddle a trench and the assembly can be lowered into the trench to compact the soil when actuated.

BRIEF DESCRIPTION OF THE DRAWINGS

FIG. 1 is a side perspective view of a sheepsfoot in accordance with the invention shown attached to the lip of the bucket of a loader or the like;

DESCRIPTION OF THE PREFERRED EMBODIMENT

Figure 1:
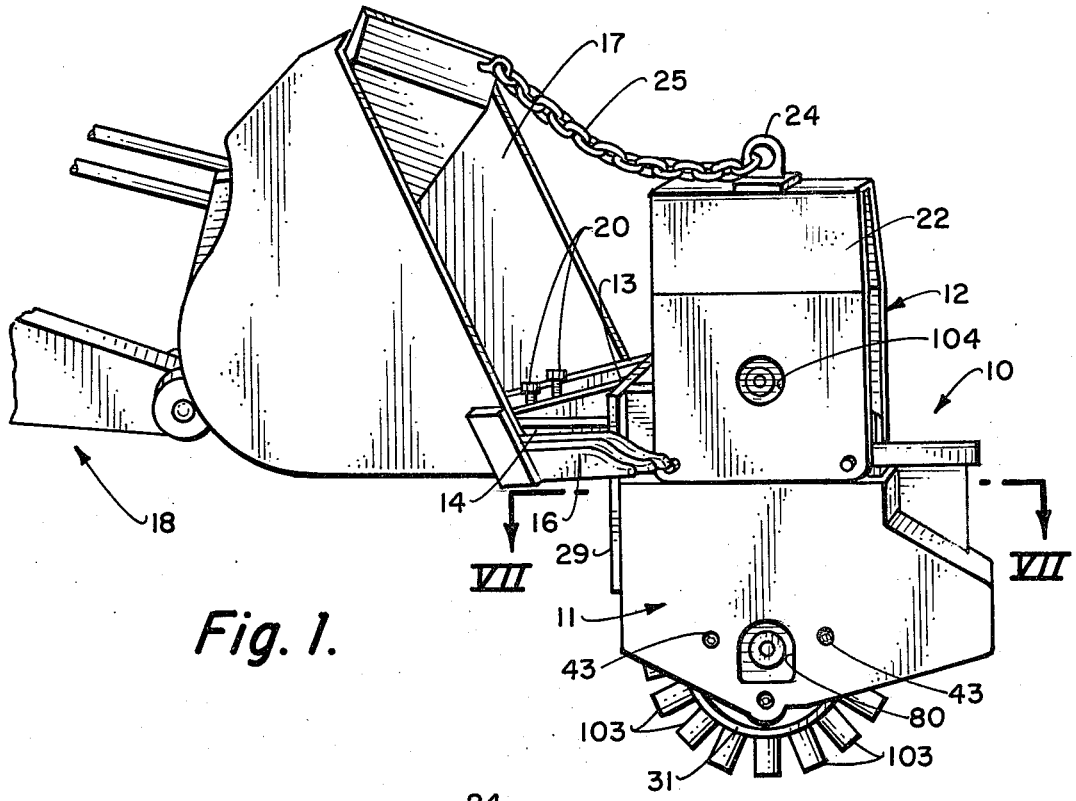
Figure 2:
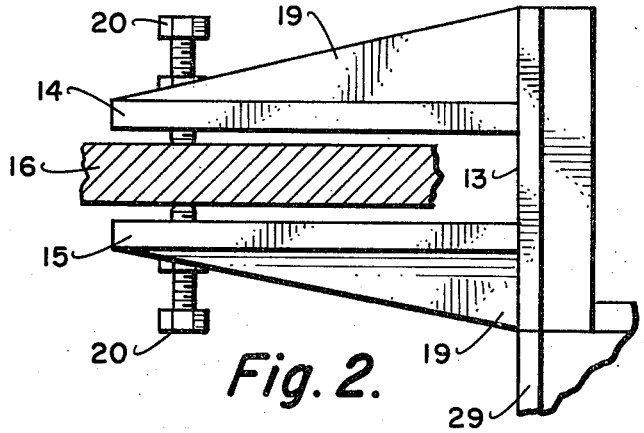
FIG. 2 is a detailed side view of a portion of the sheepsfoot and bucket lip of FIG. 1.
Figure 7:
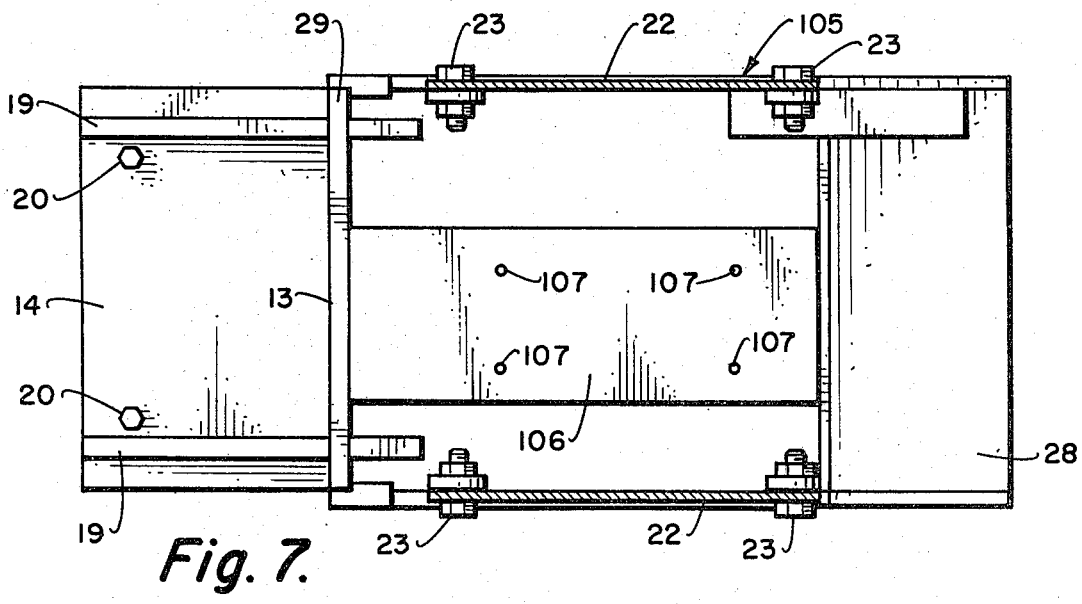
FIG. 7 is a view taken along lines VII—VII of FIG. 1.

Referring now to FIG. 1 of the drawing, a vibratory sheepsfoot 10 is shown having a sheepsfoot frame section 11, an engine housing section 12 and a mounting jaw 13. The mounting jaw 13 includes a pair of spaced rearwardly extending brackets 14, 15 (see also FIG. 2) adapted to receive therebetween the lip 16 of the bucket 17 of a loader 18 or the like. As seen in FIG. 2, brackets 14, 15 may be reinforced by gussets 19. Like gussets 19 visible in FIGS. 1 and 7 may be disposed on the other side of the mounting jaw of flange 13. A plurality of threaded bolts 20 are provided for locking lip 16 between brackets 14, 15 by threading the same against lip 16 shown in dotted lines. In this manner, sheepsfoot 10 can be quickly and easily mounted to, or be demounted from, lip 16.

It is also to be seen that bolts 20 are shown, these may be readily replaced by drop pins that would extend through the length of a bore in the mounting flange and the lip of the typical prime mover, e.g. a front loader. Furthermore, other means of attachment that could be employed are deemed to be within the skill of the art.

The mounting jaw as is seen in the figures actually consists of the brackets forming the back flange.

The term lip as utilized with this invention may be either an integral lip normally associated with a component of a prime mover, or it can be an added lip or horizontal member secured to and forming part of a prime mover for the specific purpose of mounting the instant device to such adapted prime mover.

Thus in a fork lift, a plate having apertures therein for the several tynes would be disposed horizontally across said tynes to create a solid horizontal surface. In such instance a reinforcement plate superposed in axial alignment is suggested for additional strength.

In a front loader, such as is used for gravel retrieval, since there is a large horizontally oriented wall of the loader bucket, which is larger than the width of the instant device, no separate lip is needed.

For a prime mover such as a bull dozer which has a generally vertically oriented blade, the lip would be attached either at the bottom edge preferably or horizontally across the middle of the blade.

The lip if an added member should be attached to a component of the prime mover that is elevatable in order to permit the sheepsfoot assembly to be raised and lowered. Since the operative drum is disposed vertically beneath the mounting jaw, use of the device belowground level, as in a trench is readily seen.

The lip, integral or attached need not be in a true horizontal position, provided that the component of the prime mover, such as the dozer blade is orientable to permit the lip to achieve a horizontal disposition such that when secured within the mounting jaw, vertical motion of the sheepsfoot is achieveable.

The lip need only be about 3 to 5 inches thick and of sufficient forward extension such that a secure grip between the jaws of the mounting frame can be assured.

The lip may be permanently secured to the prime mover component as by welding, or it may be removeably secured thereto as by bolting same to the prime mover. The use of additional mounting structure or support means for specific prime movers to attach the lip to a particular prime mover is readily seen and is within the skill of the art.

Another example of a prime mover that can have a lip attached thereto for interfacing with the instant device is a motor loader.

Figure 3:
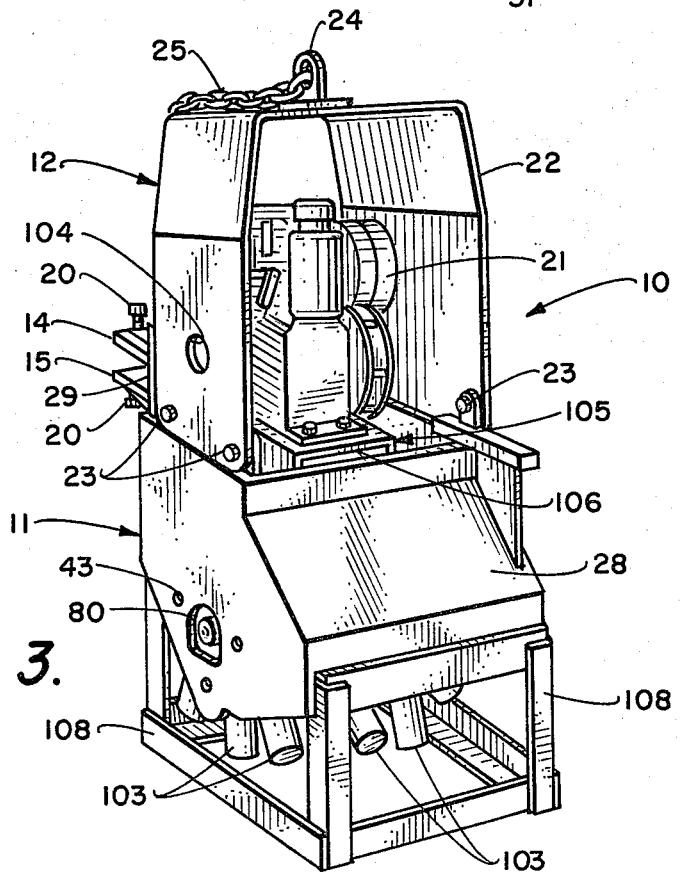
FIG. 3 is a front perspective view of the assembly of FIG. 1.

As seen in FIG. 3, the engine housing section 12 houses a conventional diesel or gasoline engine 21 covered by a protective canopy 22. Canopy 22 extends from both sides of sheepsfoot frame section 11 and is bolted thereto, by bolts 23, for easy access thereto. An apertured lifting hook flange 24 is provided on the top of canopy 22 (see also FIG. 1) and a stabilizing chain 25 leading to bucket 17 is welded thereto.

Figure 4:
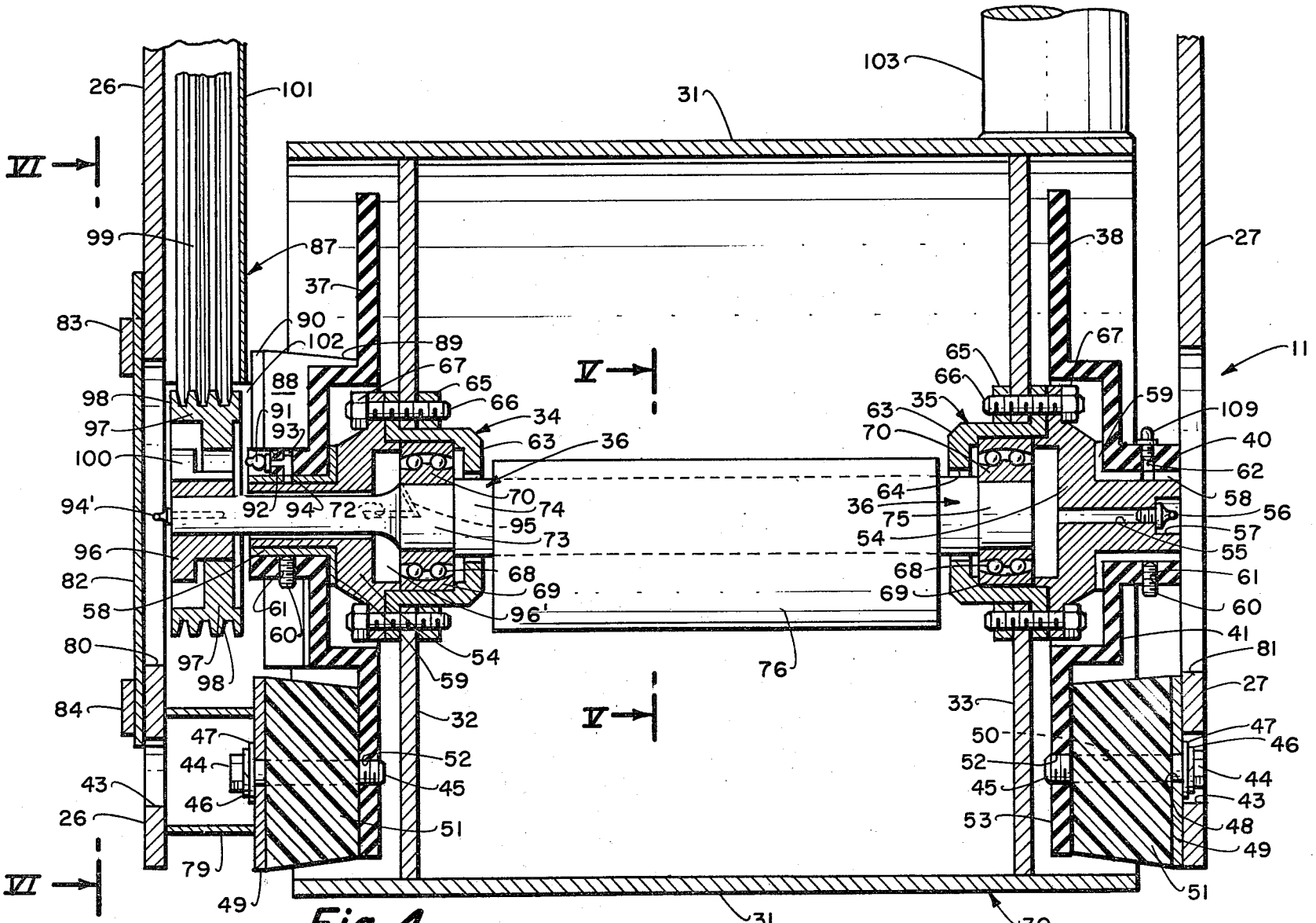
FIG. 4 is a vertical cross-sectional view of the lower drum section alone of the sheepsfoot of FIGS. 1 to 3.

Referring now to FIG. 4, the sheepsfoot frame 11 includes a pair of vertical side walls 26, 27, a sloped front wall 28 (FIG. 3) and a rear wall 29 (FIG. 1). The section 11, as shown in FIGS. 1, 3 and 4, is thus open at the top (But covered by protective canopy section 12 as will be discussed) and bottom.

Referring again to FIG. 4, a hollow rotatable drum 30 is mounted between side walls 26, 27. Drum 30 includes a cylindrical outer shell 31, which may be made from pipe or the like, and round side walls 32, 33, which may be spaced inwardly from the ends of shell 31 as shown. For example, shell 31 may have an outer diameter of 18 inches and be $\frac{3}{8}$ths inch in thickness. It may be 19 and $\frac{5}{8}$ths inches in overall length (as opposed to an overall width of section 11 of 23 and $\frac{3}{4}$ths inches or so) with walls 32, 33 spaced about 2 and $\frac{7}{8}$ths inches inwardly at each end. Walls 32, 33 may also be about $\frac{3}{8}$ths inch thick.

Drum 30 rotates in a pair of spaced roller bearing housings 34, 35 with rotating eccentric shaft 36 extending therethrough. As seen in FIG. 4, a pair of generally circular resilient mounting plates 37, 38, such as rubber plates, are disposed internally of section 11 between side walls 32, 33 and side walls 26, 27, respectively. Plate 38 is welded or otherwise secured to side wall 27 at annular joint 40. One or more countersunk openings 43 (see also FIG. 1) are provided in side wall 27 for access to the head 44 and lock washer 46 and flat washer 47 of threaded bolt 45 (see FIG. 4 as well). Bolt 45 extends through an opening 48 in a spacer 49 and through a suitable opening 50 in a resilient shock mount 51 and threaded into a threaded opening 52 in the lower end 53 of plate 38. A like shock mount 51 is provided on the outer side of the lower section 11 as shown in FIG. 4 and as will be discussed further. As shown in FIG. 1, each opening 43 may be associated with a similar shock mount 51 so that, for example, three such mounts may be provided on each side wall 26, 27.

Referring again to FIG. 4, roller bearing housing 35 includes a main housing section 54 having a throughbore 55 leading to a grease fitting 56 mounted in a countersunk hole 57. Thus, when side wall 27 is removed for servicing. Access to throughbore 55 for greasing the same is provided via hole 57 and fitting 56.

A cylindrical spacer sleeve 58, having an end flange 59, is mounted between section 54 and plate 38. One or more set screws 60, threaded in aperture 61 in plate 38, secures sleeve 58 to plate 38. Also, one or more grease fittings 109, mounted in suitable openings 62 in plate 38 and sleeve 58, may be provided.

The bearings are mounted within cup-shaped bearing sections 63 (the description of one is applicable to the other except where otherwise indicated) having an opening 64 for receiving shaft 36 therethrough. An annular flange 65 encircles the outer periphery of section 63 and abuts against side wall 33 of drum 30. One or more suitable studs 66 are threaded into threaded aligned openings in flange 65, side wall 33, section 63, and section 54, receiving locknuts 67 thereon, for securing section 63 in place. One or more ball bearings 68 are mounted in the race 69 of annular race section 70 mounted internally of section 63. Any number, type or shape of ball bearings may be used,—such as two spherical roller bearings—in each section 34, 35.

Figure 5:
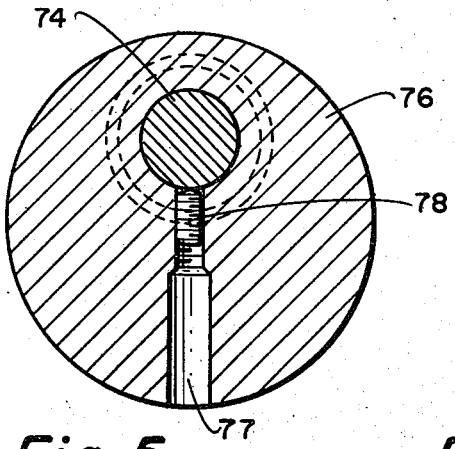
FIG. 5 is a view taken along lines V—V of FIG. 4.

As shown on the left side of FIG. 4, shaft 36 includes a reduced diameter end 71, having a throughbore 72 for receiving grease therein, a larger diameter section 73 mounted in race section 70, a still larger elongated larger diameter main section 74 extending across the interior of drum 30, and a final reduced diameter section 75 (similar to section 73) mounted in the race section 70 at the right in FIG. 4 and terminating there. A counterweight 76 (shown more particularly in FIG. 5) is mounted on shaft section 74 and may include a bore 77 having a set screw 78 for securing counterweight 76 to shaft section 74.

Figure 6:
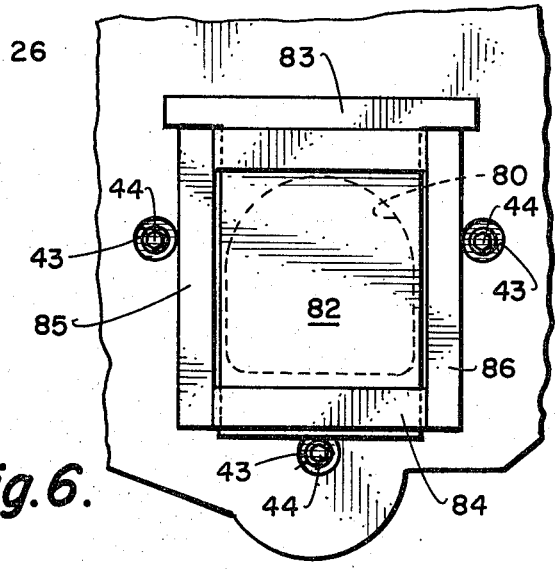
FIG. 6 is a view taken along lines VI—VI of FIG. 4.

Although there are obvious similarities between the mounting means on each side of drum 30, and like numerals refer to like parts, there are some differences. Thus, looking at the left side of drum 30 in FIG. 4, head 44 of bolt 45 is internally of the cylinder section 11 with a cylindrical spacer 79 spacing spacer 49 from wall 26. Large diameter aligned circular openings 80, 81 are provided in each side wall 26, 27, respectively, for access to the drum structure. However, as shown, a dust plate or dirt guard plate 82 may close off opening 80. Plate 82, as shown in FIG. 6, may slidably fit in behind spaced upper and lower horizontal straps 83, 84 fixedly secured to side wall 26 with vertical bars 85, 86 also mounted on well 26 as shown. Plate 82 is thus easily removable to obtain access to the sheave assembly 87 (FIG. 4) in drum section 11.

Before discussing sheave assembly 87, other differences are noted. Thus, a resilient dust member 88, having an inwardly extending lip 89, overlying plate 37 as shown, is disposed between a cylindrical spacer 90 and section 37. A grease fitting 91 closes off a T-shaped bore 92 in section 37 with plug 93 between member 88 and bore 92 closing off one passage of bore 92. Bore 92 communicates with an aligned bore 94 in sleeve 58 so that grease may be provided to right housing section 54 in FIG. 4. A grease fitting 94' closes off throughbore 72 is shaft end 71 and an angled throughbore 95, in fluid communication with throughbore 72, provides means for greasing the space 96' between shaft section 71 and section 54 as shown.

The sheave assembly 87 will now be discussed. The sheave assembly 87 includes a hub 96 fixedly mounted on shaft end 71 and rotatable therewith. A sheave section 97 is mounted to hub 96 and includes a plurality of spaced annular teeth 98 receiving thereon a power band belt 99. An aperture 100 in hub 96 provides access to fitting 91. Belt 99 is contained between the inside wall 26 and a side belt guard 101 mounted on plate 102.

A plurality of spaced compacting teeth 103 (only one shown for purposes of illustration in FIG. 4) are welded or otherwise secured to the outer periphery of drum 31 (see also FIGS. 1 and 3). Each tooth of 103 may be of any suitable dimension. Also, any spacing and number may be used, such as three peripheral rows of eight such teeth 103 spaced axially about 2⅜ths inches apart (i.e., between adjacent rows). These teeth 103 may also be staggered in rows as shown in FIGS. 1 and 3. Such teeth 103 may also be of any suitable material, such as high-alloy cast steel.

Mounted within engine housing section 12 (see particularly FIG. 3) is the aforementioned vibratory sheepsfoot machine 21. Access to machine 21 for cranking the same is provided through crank opening 104 in canopy 22. Machine 21 is mounted on an engine mounting assembly 105 including a mount block 106 mounted between front wall 28 and rear wall 29 (see also FIG. 7). Suitable openings 107 are provided in block 106 for securing machine 21 thereto. Engine 21 may then be bolted in place.

As discussed in U.S. Pat. No. 4,066,374, and as is well known in the art, engine 21 includes a motor and is a self-contained unit controlled remotely, hydraulically, electrically or manually by the operator. Such controls enable the operator to raise or lower the drum 30 and carry out all operations normally associated with trench compaction. The belt 99 is of course coupled to machine 21 and driven thereby to rotate eccentric shaft 36 as heretofore disclosed.

While the use of a belt drive has been described above, it is obvious that a gear, or chain drive or other conventional drive may be used to couple the drum to the motor.

The apparatus 10 may be quickly and easily coupled to for example, a tractor bucket, as mentioned before. Since the apparatus is attached to the prime mover, it may then be pushed or pulled by the tractor. However, since the engine is not drivingly coupled to the drum to cause the drum to rotate, the drum will only rotate when the prime mover is in motion forwardly or rearwardly. The drum does not rotate while the prime mover is idling. The engine 21 provides the power via the belt drive 99 to spin the eccentric shaft 36 thereby creating the vibratory dynamic compactive stress desired, and only this vibratory motion. This vibratory motion will occur whether the drum is in rotation or is in a steady state situation. Thus it is seen that power is transmitted from the engine thru a centrifugal clutch to the belt 99 and then to the eccentric shaft 36. Engine 21 vibrates teeth 103 which in turn impact on the soil to compact same.

The apparatus disclosed herein may be used to compact narrow trenches, e.g., 18 inches wide or more and to a desired depth, e.g., 5 feet or more.

Any suitable engine 21 may be used, i.e., diesel, gasoline or hydraulic. For example, the engine 21 may be a Hatz-air cooled engine, Type E-780, with a maximum horsepower of 10 at 3,000 RPM. The conventional operating speed may be 2500 RPM and the engine may be hand cranked manually to start. Of course, an electric start may be provided. Decompression may be automatic and a one cylinder engine may be used. Engine speed may be controlled by a Morris control for hi-speed when compacting or lo-speed when idling. With the foregoing arrangement, a drum vibration of 2500 vibrations per minute (VPM) may be obtained with a total engine speed of 2500 RPM.

Any suitable dimensions may be used, such as an overall width of about 24 inches, a drum width of about 20 inches, a drum diameter of about 18 inches, and an overall weight of about 1200 pounds. When not in use, the entire apparatus 10 may be rested on an open sturdy framework 108 as shown in FIG. 3.

The improved compactor disclosed herein produces compaction that meets or exceeds most soils' engineering specifications. It operates efficiently in narrow or shallow trenches and may be remotely operated from the loader. It may be operated with the loader bucket in a float position. It mounts to any loader bucket or similar lip structure on a prime mover blade. It may be easily lifted over cross-pipes, valves, etc. and may be quickly and easily attached or demounted. Hook flange 24 may be used to lift the same between mount and storage.

The upper vibratory machine housing section may also be known as a sheepsfoot frame section, among those skilled in the art.

In operation it is seen therefore that when the prime mover moves forwardly, the drum will rotate in circular motion as it moves in a horizontal plane. Vibration on the other hand occurs whether or not the drum is moving forwardly, rearwardly or remaining stationary. The vibration is due to the operative connection of the engine via the belt drive, to the eccentric shaft.

It can be seen that there is disclosed an improved trench compactor which can produce soil compaction in native soils without pipe breakage and can productively compact cohesive clays, clay mixes and granular native materials.

Since certain changes may be made in the above apparatus and method without departing from the scope of the invention herein involved, it is intended that all matter contained in the above description and shown in the accompanying drawings, if any, shall be interpreted as illustrative and not in a limiting sense.

I claim:

1. A sheepsfoot assembly for mounting upon the lip of a dozer or other prime mover, which comprises:

an upper vibratory machine housing section for a motor and clutch assembly, a motor and a clutch assembly mounted therein, a lower vibratory sheepsfoot section undermounted thereto, said lower section having a sheepsfoot frame which includes a pair of spaced vertical side walls, and spaced front and rear walls, the rear of which is vertical and normal to said side walls, a pair of spaced bearing mounts disposed interior of each side wall, a shaft journalled for rotation in said bearing mounts, a drum mounted to said shaft and rotatable therewith, said drum having a plurality of spaced rows of compacting teeth extending outwardly from the outer periphery of said drum, means interconnecting said drum and said motor for vibrating said drum when said motor is actuated, mount means for securing said sheepsfoot assembly to said prime mover, said mount means comprising a back flange secured generally vertically upon the rear wall of said lower section and a pair of vertically spaced parallel brackets extending rearwardly outward from and normal to said back flange for receiving said lip, and at least one pair of vertically aligned apertures disposed in said brackets and adapted to receive securing means therein.

2. In the assembly of claim 1 wherein said upper vibratory machine housing section includes a removable canopy extending over said machine and partially enclosing the same.

3. In the assembly of claim 2 including an apertured lifting flange mounted on the upper surface of said canopy, and a chain fixedly secured to the upper surface of said canopy.

4. In the device of claim 1 wherein the back flange is secured to the top edge of the rear wall of said lower sections.

5. In the device of claim 1 wherein the aligned apertures are threaded, and the securing means are threaded bolts.

6. In the device of claim 1 wherein the aligned apertures are not threaded and the securing means are drop pins.

7. In the device of claim 1 further including reinforcing gussets connected to both the back flange and one of said brackets.

8. In the device of claim 7 wherein both of said brackets are each reinforced by a pair of spaced gussets.

9. In the device of claim 8 wherein there are two sets of aligned threaded apertures, adapted to receive threaded bolts therein.

* * * * *